US005105837A

United States Patent [19]

Barnes et al.

[11] Patent Number: 5,105,837

[45] Date of Patent: Apr. 21, 1992

[54] SMOKING ARTICLE WITH IMPROVED WRAPPER

[75] Inventors: Russell D. Barnes, Belews Creek; Kelly K. Hutchison, Kernersville, both of N.C.; Carmen P. Digrigoli, Canton, Ga.; Loyd G. Kasbo, Norcross, Ga.; Peter E. Brighenti, Marietta, Ga.; William F. Cartwright, Roswell, Ga.; Benjidawn Morgan, Atlanta, Ga.

[73] Assignee: R. J. Reynolds Tobacco Company, Winston-Salem, N.C.

[21] Appl. No.: 574,327

[22] Filed: Aug. 28, 1990

[51] Int. Cl.[5] ..... A24D 1/00; A24D 1/02; A24D 1/18

[52] U.S. Cl. ..... 131/365; 131/194

[58] Field of Search ..... 131/365, 194

[56] References Cited

U.S. PATENT DOCUMENTS

| | | | |
|---|---|---|---|
| 2,907,686 | 10/1959 | Siegel . | |
| 3,258,015 | 6/1966 | Ellis . | |
| 3,356,094 | 12/1967 | Ellis . | |
| 3,395,714 | 8/1968 | Kahane | 131/365 |
| 3,516,417 | 6/1970 | Moses . | |
| 4,079,742 | 3/1978 | Rainer et al. . | |
| 4,340,072 | 7/1982 | Bolt et al. . | |
| 4,474,191 | 10/1984 | Steiner . | |
| 4,708,151 | 11/1987 | Shelar . | |
| 4,714,082 | 12/1987 | Banerjee et al. . | |
| 4,756,318 | 7/1988 | Clearman et al. . | |
| 4,771,795 | 9/1988 | White et al. . | |
| 4,793,365 | 12/1988 | Sensabaugh, Jr. et al. . | |
| 4,807,809 | 2/1989 | Pryor et al. . | |
| 4,827,950 | 5/1989 | Banerjee et al. . | |
| 4,854,332 | 8/1989 | Hanakura . | |
| 4,858,630 | 8/1989 | Banerjee et al. . | |
| 4,893,637 | 1/1990 | Hancock et al. . | |
| 4,893,639 | 1/1990 | White . | |
| 4,903,714 | 2/1990 | Barnes et al. . | |
| 4,938,283 | 7/1990 | Barnes et al. . | |

FOREIGN PATENT DOCUMENTS

| | | |
|---|---|---|
| 212234 | 3/1987 | European Pat. Off. . |
| 236992 | 9/1987 | European Pat. Off. . |
| 257230 | 3/1988 | European Pat. Off. . |
| 299260 | 1/1989 | European Pat. Off. . |
| 299272 | 1/1989 | European Pat. Off. . |
| 304759 | 3/1989 | European Pat. Off. . |

OTHER PUBLICATIONS

Kirk-Othmer Encyclopedia of Chemical Technology 3 ed. vol. 6 (1979) p. 396.

*Primary Examiner*—V. Millin

*Attorney, Agent, or Firm*—Grover M. Myers; David G. Conlin

[57] ABSTRACT

A wrapper for use in smoking articles such as cigarettes, and in particular, to a wrapper for smoking articles having a heat source, a physically separate aerosol generating means, and a mouthend piece. More specifically the invention relates to smoking articles which employ a substantially non-burnable paper used as an innerwrap and/or outerwrap which encircles at least a portion of the fuel element of such smoking articles.

48 Claims, 4 Drawing Sheets

SMOKING ARTICLE WITH IMPROVED WRAPPER

FIELD OF THE INVENTION

The present invention relates to a wrapper for use in smoking articles such as cigarettes, and in particular, to a wrapper for smoking articles having a heat source, a physically separate aerosol generating means, and a mouthend piece. More specifically, the invention relates to smoking articles which employ a substantially non-burnable paper used as an innerwrap and/or outerwrap which encircles at least a portion of the fuel element of such smoking articles.

BACKGROUND OF THE INVENTION

Cigarettes, cigars and pipes are popular smoking articles which use tobacco in various forms. Many smoking products and smoking articles have been proposed through the years as improvements upon, or alternatives to, the various popular smoking articles.

Many tobacco substitute smoking materials have been proposed, and a substantial listing of such materials can be found in U.S. Pat. No. 4,079,742 to Rainer et al. Tobacco substitute smoking materials having the tradenames Cytrel and NSM were introduced in Europe during the 1970's as partial tobacco replacements, but did not realize any long-term commercial success.

Numerous references have proposed smoking articles which were used to generate flavored vapor and/or visible aerosol. See, for example, U.S. Pat. No. 2,907,686 to Siegel; U.S. Pat. Nos. 3,258,015 and 3,356,094 to Ellis et al.; U.S. Pat. No. 3,516,417 to Moses; U.S. Pat. No. 4,340,072 to Bolt and U.S. Pat. No. 4,474,191 to Steiner.

In European Patent Publication No. 212,234; and U.S. Pat. Nos. 4,708,151; 4,714,082; 4,756,318, 4,793,365, 4,827,950, 4,858,630, 4,893,637, 4,893,639, 4,903,714 and 4,938,238; assigned to R. J. Reynolds Tobacco Co., there are described smoking articles which are capable of providing the sensations associated with cigarette and pipe smoking, without the necessity of burning tobacco and without delivering considerable quantities of incomplete combustion products. Such smoking articles employ an aerosol generating means, physically separate from and in a heat exchange relationship with a fuel element. The aerosol generating means normally includes tobacco in various forms such as densified pellets, tobacco extracts, as well as tobacco flavor modifiers and tobacco flavoring agents and aerosol forming substances such as glycerin.

It would be desirable to provide substantially non-burnable papers or wrappers which encircle at least a portion of the fuel elements of such smoking articles, where the porosity of such wrappers, and therefore the air flow to fuel element, is substantially independent of the physical changes which the wrapper undergoes during smoking and where the wrapper chars rather than burns, leaving a substantial portion of the charred cellulosic content of the wrapper intact during smoking.

SUMMARY OF THE INVENTION

The present invention relates to a unique wrapper especially suited for use as the wrapper for smoking articles having a heat source such as a combustible fuel element and a physically separate aerosol generating means. The wrapper, which at least partially encircles the fuel element, comprises one or more substantially non-burnable papers which, during burning of the fuel element, assists in controlling the amount of peripheral air to the fuel without requiring substantial burn-out of the cellulosic content of the paper. The cellulosic content of the wrapper of the present invention chars rather than burns. This contributes to the ash (char) integrity without significantly increasing or decreasing the porosity of the wrapper during smoking. Preferred smoking articles of the present invention are capable of providing the user with the pleasures of smoking (e.g., smoking taste, feel, satisfaction, and the like).

Wrappers prepared in accordance with the present invention help to reduce the variability of delivery associated with different lighting and/or smoking practices by reducing the variability of the amount of the wrapper that burns during smoking, particularly for smoking articles such as those described in the above-referenced European Patent Publication 212,234 and U.S. Pat. No. 4,938,238. The present invention also relates to smoking articles which employ such wrapper materials.

Preferred smoking articles of the present invention employ a carbonaceous fuel element having a length less than about 30 mm prior to smoking, and an aerosol generating means longitudinally disposed behind the fuel element (i.e., towards the mouth end of the smoking article relative to the fuel element). Normally, the aerosol generating means is in a heat exchange relationship with the fuel element. A resilient insulating member, normally at least about 0.5 mm thick, preferably circumscribes the periphery of the fuel element. Preferred smoking articles also include a mouthend piece, normally having the form of a filter plug segment. Preferred filter segments exhibit low filtration efficiencies, so as to minimize interference with the passage of aerosol from the aerosol generating means to the mouth of the smoker during draw (i.e., upon use). This insulating material may also include tobacco, tobacco extract and the like to improve flavor, aroma and color. Also preferred are smoking articles which employ a segment of flavor-containing material, such as a gathered or pleated tobacco paper or a menthol-containing pleated carbon filled sheet between the aerosol generating means and the filter segment.

Preferred smoking articles of the present invention include a roll or charge of tobacco, normally in cut filler form, wrapped in a wrapping material such as paper, thereby forming a tobacco rod. The tobacco can be in a processed form, such as volume expanded cut filler or aqueously extracted/volume expanded cut filler. The tobacco rod can also include an insulating material such as glass fibers as a component thereof.

Preferred smoking articles also include an aerosol generating means physically separate from, and longitudinally disposed behind the fuel element. Preferably the aerosol generating means is enclosed in a container or housing which is heat conductive or otherwise heat-resistant and is located in a passage of the tobacco rod which extends longitudinally through the tobacco rod.

The container contains one or more aerosol forming materials. Such aerosol forming materials can include tobacco e.g., in the form of tobacco dust, spray dried tobacco extracts or tobacco essences, and/or tobacco flavoring agents such as sugars, licorice and cocoa. Other aerosol forming materials also include polyhydric alcohols, such as glycerin, propylene glycol and triethylene glycol, which vaporize to produce a visible, "smoke-like" aerosol. The aerosol forming materials within the container typically are carried by a substrate such as alumina beads, a fibrous carbon material, densified (e.g., marumerized) tobacco, carbon or alumina, or mixtures thereof.

The short fuel element is preferably longitudinally disposed in front of the container. The mouthend piece is preferably located at the other end of the container, although the mouthend piece can be separated from the container, e.g., by a chamber or one or more spacer members, which members can contain flavorants or aerosol forming materials. In accordance with the present invention, the fuel element, which is circumscribed by the insulating jacket, is at least partially encircled by one or more substantially non-burnable papers or wrappers. As noted above, these wrappers help control the amount of air supplied to the periphery of the fuel element without requiring substantial burn-out of the cellulosic content of the wrappers, and also help to reduce the variability of delivery associated with different lighting and/or smoking practices by reducing the variability of the amount of the wrapper that burns during smoking.

The advantages of the wrapper of the present invention are obtained by the use of a wrapper having applied thereto a burn retardant such as $CaCl_2$ in an amount which prevents substantial burn-out of the cellulosic content of the wrapper. Preferably there is also applied a char-lightening agent such as chalk or $TiO_2$. The wrapper of the present invention assists in controlling the amount of peripheral air supplied to the burning fuel element, helps to reduce sidestream smoke, produces an ash color which is similar to the ash color of typical cigarettes, and provides a more uniform delivery of aerosol over the life of the article.

As noted above, the wrapper of the present invention encircles at least a portion of the fuel element and preferably, the jacket of insulating material which normally encircles the fuel element.

In previous smoking articles, such as those described in the above-referenced European patent publication 212,234 and U.S. Pat. No. 4,938,238, which utilize a layer of insulating material where the wrapper substantially burns away from the jacketed fuel element, heat transfer from the fuel element to the aerosol generating means depends in large part on substantial burn-out of the cellulosic content of the wrapper. However, the cellulosic content of the wrapper of the present invention is designed to remain wholly or partially intact upon lighting and exposure to heat from the burning fuel element without significantly increasing or decreasing the porosity of the wrapper. The wrapper of the present invention, helps to control air flow to the burning fuel element, reduces the variability of delivery associated with the smoker's lighting and smoking practices, and reduces the sidestream smoke while maintaining and/or improving uniformity of delivery aerosol to the user.

The wrapper preferably comprises one or more sheet materials, at least one of which contains a sufficient amount of burn retardant to prevent or substantially retard the burn-out of the cellulosic content thereof. The wrapper also serves, at least in part, to maintain the integrity of the various components of the front end of the article, especially when the wrapper is used to wrap other components of the article, such as the preferred insulating jacket. Preferred wrappers also contain a char-lightening agent such as chalk (e.g., calcium carbonate) or $TiO_2$ which provides an ash which has the appearance of typical cigarette ash.

In certain preferred embodiments, the wrapper of the present invention comprises a combination of high porosity wrappers including a high porosity innerwrap, which upon lighting of the fuel element chars but does not substantially burn and which maintains a high porosity during smoking, and a high porosity outerwrap which upon lighting also chars but does not substantially burn and which also assists in controlling the amount of peripheral air to the burning fuel element. The outerwrap preferably contains a coating of a char-lightening agent such as chalk. This combination of wrappers provides advantages of uniform aerosol delivery, reduction in the variability of aerosol due to different lighting and/or smoking practices, and helps to maintain the integrity of the various components of the article during smoking.

Preferred smoking articles employing the wrapper of the present invention are capable of delivering at least 0.6 mg of the aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, certain of the preferred smoking articles of the present invention are capable of providing an aerosol which is chemically simple, consisting essentially of air, oxides of carbon, water, the aerosol former, any desired flavors or other desired volatile materials, and trace amount of other materials. The aerosol preferably also has no significant mutagenic activity as measured by the Ames Test. In addition, preferred smoking articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like" generated by action of the heat from the burning fuel element upon substances contained within the aerosol generating means, or elsewhere in the article.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and the like materials, as well as materials which fuse during use, such as low temperature grades of glass fibers. Suitable insulators have a thermal conductivity in g-cal(sec) ($cm^2$) (°C./cm), of less than about 0.05, preferably less than about 0.02, most preferably less than about 0.005. See, *Hackh's Chemical Dictionary* 672 (4th ed., 1969) and Lange's *Handbook of Chemistry* 10, 272–274 (11th ed., 1973).

Smoking articles employing the wrapper material of present invention are described in greater detail in the accompanying drawings and the detailed description of the invention which follow.

DETAILED DESCRIPTION OF THE PREFERRED EMBODIMENTS

Figure 1:
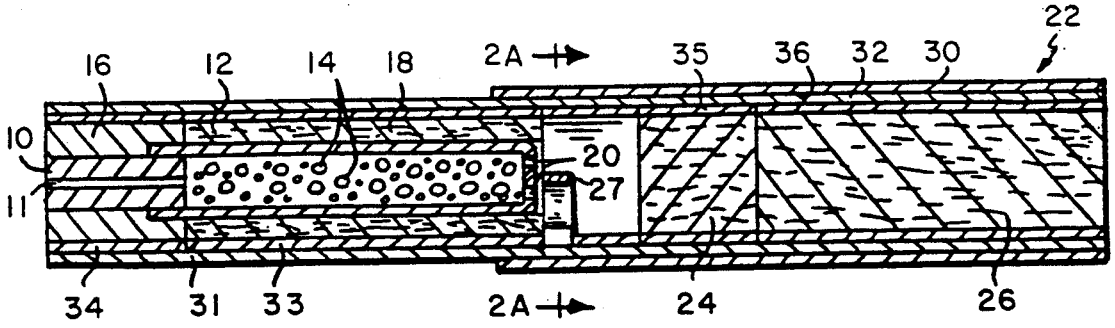
FIG. 1 is a longitudinal view of one preferred smoking article which may employ the wrapper of the present invention.

In accordance with the present invention, there is provided a unique substantially non-burnable wrapper for use in smoking articles, which wrapper assists in providing sufficient amounts of air to the periphery of the fuel element. The wrapper is particularly suited for smoking articles having a combustible fuel encircled at least in part by an air permeable insulating layer and a physically separate aerosol generating means such as those articles described in the above-referenced EPO Publication No. 212,234.

As will be appreciated by the skilled artisan, the consistency and amount of air flow to the fuel element provided by the substantially non-burnable wrapper in accordance with the present invention is system-dependent and will vary with a number of factors. Such factors include the amount of energy generated by the fuel source, the heat sink effect due to the particular aerosol generating means employed, the amount of aerosol former, the physical characteristics of any substrate material used to carry the aerosol former, the moisture content of the aerosol former, and the type and thickness of the insulating jacket which circumscribes the fuel element, total mass of the front end, the amount of air which goes through the fuel as compared with the amount which passes through the surrounding tobacco rod or other air permeable insulating material, the degree of thermal conductivity of the front end components, the pressure drop across the article, and the like.

Controlling the amount of air which reaches the periphery of the fuel element by use of a wrapper in accordance with the present invention is believed to be important for a number of reasons. For example, it allows the consistency and amount of air flow to the fuel element to remain relatively constant during lighting and throughout smoking. Because of the lack of substantial burn-out of the cellulosic content of the wrapper of the present invention, air flow to the burning fuel element is relatively independent of the physical and chemical changes caused by lighting the smoking article.

One important aspect of the wrapper of the present invention is the charring rather than burning of the celluolosic content of the wrapper. Charring is believed to provide a controlled amount of air flow to the periphery of the fuel element since the remaining portion of the wrapper, namely the charred cellulose and/or ash constituents, are left substantially intact during smoking of the article. In previous smoking articles such as those described in the above-referenced EPO publication, the paper circumscribing the fuel element normally substantially burns out to provide sufficient air flow to the fuel. In other words, the control of air flow in previous smoking articles either disappears as the fuel and surrounding paper burn back or requires a special component to provide the necessary air flow to the fuel, e.g., the use of glass fibers which fuse to provide the desired air flow to the fuel element as in the smoking articles described in the above-identified U.S. Pat. No. 4,938,238.

Figure 5:
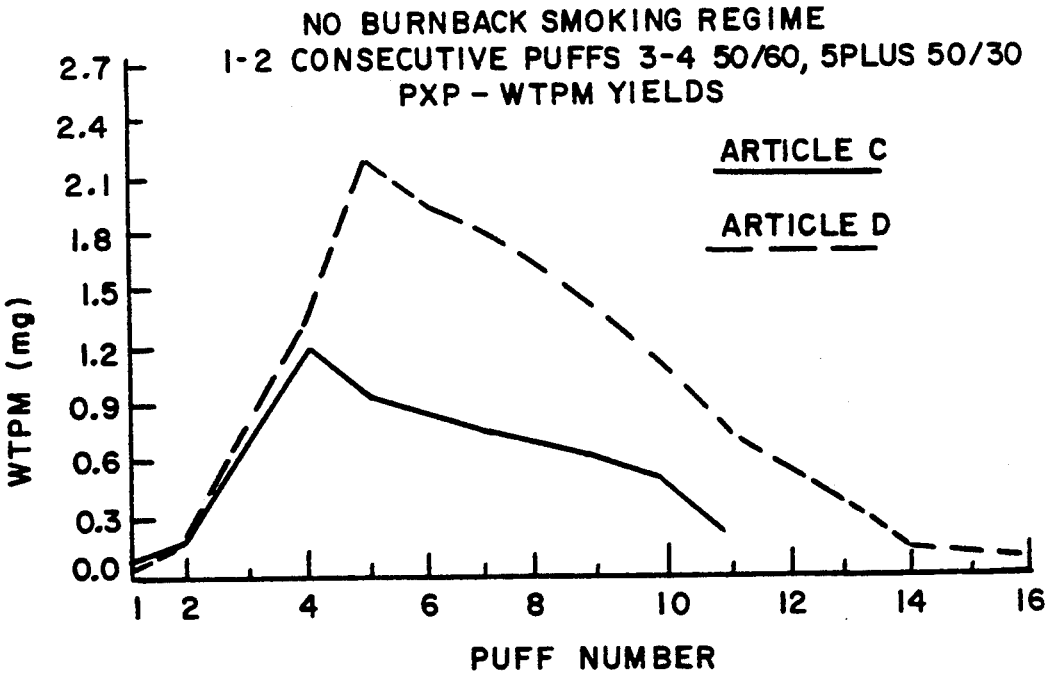
FIG. 5 illustrates the aerosol delivery of previous smoking articles with smoking articles employing the wrapper of the present invention under a no burnback smoking regime.

Controlling air flow to the fuel element is also important in minimizing the variability in delivery due to differences in the smoker's lighting and/or smoking practices. As will be appreciated, a smoker's lighting and/or smoking parctices may range from those referred to as FTC smoking conditions (35 ml puffs of two seconds duration, separated by 58 seconds of smolder) to exagerated practices such as a few immediate puffs followed by a relatively large amount of smoldering time. Where, for example, a smoker who lights a smoking article employing previous wrapper systems (such as those described in U.S. Pat. No. 4,938,238) takes only one or two puffs and puts the article down for a minute or so before the next puff, the amount of aerosol delivery over the life of the smoking article will be greatly reduced. This is believed to be primarily due to incomplete burn-out of the wrapper portion surrounding the fuel element. The wrapper of the present invention helps to reduce such variability in deliveries during smoking by providing the desired consistency and amount of air flow to the fuel element during lighting and throughout smoking. See FIG. 5 which compares smoking articles employing a wrapper system such as that described in U.S. Pat. No. 4,938,238 (depicted as "Article C") with smoking articles employing the wrapper in accordance with the present invention (depicted as "Article D"). As can be seen from FIG. 5, there is an overall decrease in aerosol delivery (WTPM) for Article A when a no burnback smoking regime is employed, which is believed to be primarily due to a decrease in the amount of peripheral air to the fuel element. Article D, on the other hand, which employs the wrapper of the present invention, provides the desired amount of aerosol delivery despite the relatively restrictive no burnback smoking regime. The no burnback smoking regime comprises 1-2 immediate consecutive puffs upon lighting, with puffs 3 and 4 taking place one minute later and being 50 ml puffs separated by 60 second intervals, with puffs 5 and later being 50 ml puffs separated by 30 second intervals.

Figure 4:
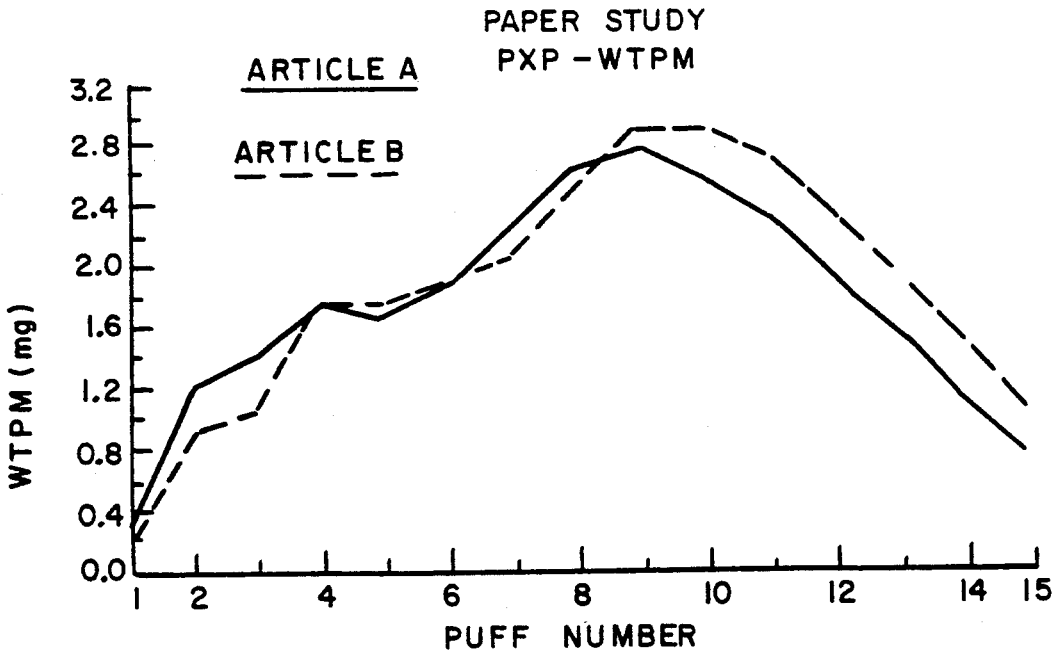
FIG. 4 illustrates a typical aerosol delivery curve comparing previous smoking articles with smoking articles employing the wrapper of the present invention.

Controlling air flow also helps to control the WPTM produced in peak puff delivery, which helps to produce more uniform aerosol delivery over the life of the smoking article. Such control helps provide the desired puff count while maintaining the desired WPTM, e.g. by increasing the life of the fuel element. As can be seen from FIG. 4, when smoked under FTC smoking conditions, the wrapper of the present invention (depicted as "Article B") provides desirable amounts of aerosol achieved with previous wrapper systems (depicted as "Article A") such as those in the above-referenced U.S. Pat. No. 4,938,238.

Controlling the air flow to the fuel element also helps to reduce the gas temperature by controlling the amount of peripheral air which reaches the aerosol generating means, thereby reducing the temperature of the aerosol perceived by the user.

The wrapper of the present invention which chars rather than burns, also helps in reducing the amount of sidestream smoke. Reduction in sidestream smoke is believed to be due, in part, to the reduction in the amount of cellulosic content which burns during smoking, particularly during the early puffs.

In accordance with one aspect of the present invention the wrapper comprises one or more cigarette wrappers or similar papers which are chemically treated with a burn retardant in order to substantially reduce the burn-out of the cellulosic content of the paper while maintaining the desired consistency and amount of air to the periphery of the burning fuel element during lighting and throughout smoking.

The porosity of the inner/outerwrap paper may range broadly depending on a number of factors including the physical characteristics of the fuel source, (e.g., the number and placement of passageways), the burning characteristics of the fuel source (e.g., how hot the fuel burns during smoking), the density of the tobacco rod and/or insulating material which surrounds the fuel source and/or aerosol generating means, as well as the above-described system dependent factors. In general, the Coresta porosity may range between about 5 and 6500 cm/min, preferably between about 100 and 3000 cm/min, and most preferably between about 300 and 2000 cm/min.

As discussed below, in certain preferred embodiments a burn retardant such as calcium chloride incorporated into the base innerwrap and/or outerwrap during processing, and a char-lightening agent and other additives are applied to the outerwrap as a coating. In these preferred embodiments the porosity of the base wrapper (innerwrap and/or outerwrap) is decreased by application of the coating. After lighting of the smoking article, however, as the coating decomposes, the porosity of the coated wrapper approaches that of the base wrapper.

Burn retardants which can be used in accordance with the present invention include inorganic salts which lower the decomposition temperature of cellulose under smoking conditions such as inorganic halides, sulfates and phosphates. Suitable chloride salts include calcium chloride, ammonium chloride, magnesium chloride. Calcium chloride is the preferred burn retardant. Other burn retardants which may be used include sulfates such as magnesium sulfate, mono-ammonium sulfate, and phosphates such as disodium phosphate.

The burn retardant is preferably applied to the above cigarette paper in a way and in an amount such that upon lighting of the smoking article, the treated cigarette paper chars but does not substantially burn-out the cellulosic content of the paper.

The amount of burn retardant will also depend on the above-described porosity and system-dependent factors as well as whether or not an inner and/or outer wrapper, or both, are used to circumscribe the fuel element. The amount of burn retardant should be sufficient such that greater than about 30 weight percent of the wrapper (surrounding the fuel portion of the smoking article) in the form of charred cellulose and/or ash constituents remains after the article is lit. Preferably, greater than about 40 weight percent remains, most preferably between about 45-75 weight percent remains.

Figure 6:
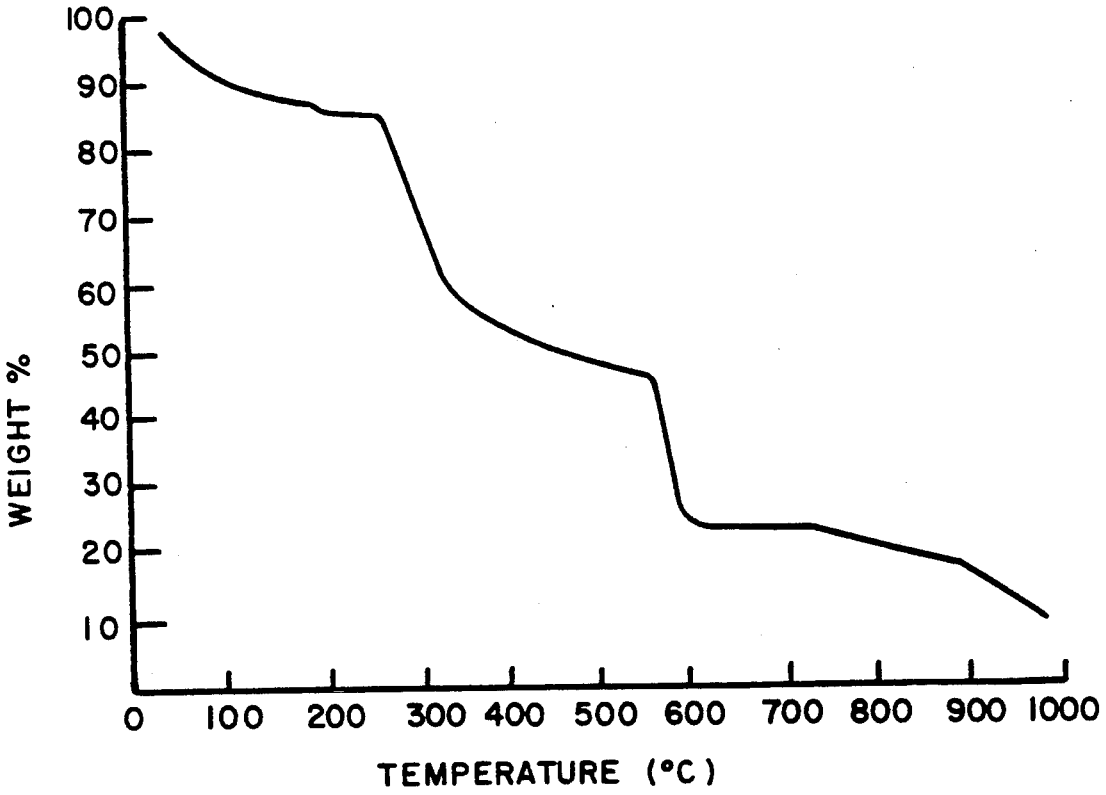
FIG. 6 depicts a thermogravametric analysis of the wrapper material of one embodiment of the present invention.

The amount of the wrapper in the form of charred cellulose and/or ash constituents remaining can be easily determined by thermogravametric analysis, for example on a Dupont 2100 thermogravametric analyzer. FIG. 6 illustrates the thermogravametric analysis of one preferred wrapper of the present invention, namely an experimental paper designated P2674-190 which contains both burn retardant and a coating comprising chalk, Kasil ® and CMC. As can be seen from FIG. 6, the amount of charred cellulose and/or ash constituents of the paper between 250° and 550° C. (the temperature to which wrappers that surround the fuel element of preferred smoking articles are exposed) is between about 45 and 75 weight percent. It should be noted, however, addition of a coating to the wrapper such as those included in the P2674-190 wrapper described in Example 1, below will influence these percentages depending on the amount of coating applied.

In general, the amount of burn retardant applied to the inner and/or outer wrapper is between about 3 to 15 weight percent, preferably between about 6 to 13 weight percent, and most preferably between about 8 to 11 weight percent.

Char-lightening agents which can be used in accordance with the present invention include chalk, clays, $TiO_2$, MgO and the like. $TiO_2$ and chalk are the preferred char-lightening agents, particularly in combination with the preferred burn retardant, $CaCl_2$.

The amount of char-lightening agent used depends on a number of factors including the degree of lightening desired, whether the char-lightening agent is applied to the wrapper or added as a component of the pulp used to make the wrapper, the porosity of the wrapper, the amount of burn retardant and other additives applied to the wrapper, and the like. For example, when the burn retardant is $CaCl_2$, the amount of char-lightening agent should be between about 1 and 50 weight percent, preferably between about 4 and 20 weight percent, and most preferably between about 6 and 8 weight percent.

Other additives which are also useful in certain preferred embodiments of the present invention include agents which interact with and/or facilitate application of the burn retardant and/or lightening agent. Such additives include hydrated silicates such as KASIL ®, and binders such as CMC, Guar Gum and Kelgin. The amount of any particular additive used also depends on a number of factors including the type and amount of burn retardant and char-lightening agent used as well as how these components are applied to the wrapper. In certain preferred embodiments, it has been found that the addition of additives such as Kasil® has a synergistic effect on the char-lightening agent used.

In general, when Kasil® is the additive, the amount of additive used is between about 1 and 15 weight percent, preferably between about 2 and 8 weight percent, most preferably between about 3 and 5 weight percent. For gums, the amount is between about 0.1 and 5 weight percent, preferably between about 0.25 and 3 weight percent, most preferably between about 0.5 and 1.5 weight percent.

As will be appreciated by the skilled artisan, a number of conventional processes may be employed to apply the burn retardant and/or char-lightening agent and/or other additives. Such processes include the metering rod coating method, the air knife, knife over blanket or the kiss coating method. The preferred process is the metering rod coating method. For a description of this process, see, e.g., Kirk-Othmer ENCYCLOPEDIA OF CHEMICAL TECHNOLOGY, 3ed. , Vol. 6, (1979) at page 396, the disclosure of which is incorporated by reference herein.

While the burn retardant and other components may be added in any order or together, it is preferred that the burn retardant be applied to or incorporated in the wrapper prior to the other components, which are preferably added to the outerwrap as a coating. More preferably, the burn retardant is added to the pulp mixture used to form the wrapper.

As noted above, the application of a coating to either the innerwrap or outerwrap in accordance with the present invention decreases the porosity of the base wrapper. After lighting, the coating decomposes and the porosity of the remaining wrapper approaches that of the base wrapper prior to coating.

While, as noted above, the inner and outer wrapper requirements can be met with typical cigarette papers, preferred inner and outer wrapper are preferably met by an experimental paper obtained from Kimberly-Clark Corporation, designated P2674-190 and P2674-52 respectively.

In general, the preferred outerwrap composition of papers such as P2674-190 is:

| Base Paper | |
|---|---|
| Basis Weight | about 34 g/m$^2$ |
| Hydrated bleached kraft pulp | about 88–89 weight percent |
| Coresta porosity | 500 cm/min. |
| Burn additive | about 11 weight percent $CaCl_2$ |
| Reactive size | about 0.3 weight percent Hercon ®70 |

Coating (as a weight percent of the base paper)

7.8% chalk
4.3% Kasil®
1.0% CMC

The preferred innerwrap composition of papers such as P2674-52 is:

| Base Paper | |
|---|---|
| Basis Weight | about 28 g/m$^2$ |

-continued

| Base Paper | |
|---|---|
| in g/m$^2$ | |
| Hydrated bleached kraft pulp | about 91–93 weight percent |
| Coresta porosity | 1400 cm/min. |
| Burn additive | about 6–8% $CaCl_2$ |
| Reactive size | 0.3% Hercon ®70 |

When char-lightening agents such as chalk and $TiO_2$ are used to coat the wrapper of the present invention they are not believed to function as a typical opacifying pigment, but instead serve in an unknown chemical fashion to provide the desired light gray ash color. When omitted, the char is black and unappealing.

Production of the paper of the present invention may be made using conventional papermaking techniques as will be known to those skilled in this art. In general, the sheet components are mixed with water and the slurry applied to a papermaking wire where the water is removed and the sheet dried by passing over and between heated rolls. Reactive sizes such as Hercon®70 or Aquapel® (from Hercules Chemical Co.) are advantageously used to increase the strength of the paper during processing. Other web forming techniques such as air forming may also be used as desired.

The thickness or caliper of the paper layers in the preferred innerwrap/outerwrap combination embodiment will normally be similar to that of typical cigarette papers.

Smoking articles in which the wrapper of the present invention is useful and the various components thereof, are described in greater detail in U.S. Pat. Nos. 4,771,795 to White et al.; 4,714,082 to Banerjee et al.; 4,756,318 to Clearman et al.; 4,793,365 to Sensabaugh et al.; 4,827,950 to Banerjee et al. and 4,938,238 to Barnes et al., and in European Patent Publication No. 212,234; all of which are incorporated herein by reference. Methods for making suitable fuel elements are set forth in European Patent Publication No. 236,992, which is incorporated herein by reference. Apparatus suitable for assembling preferred substrate-filled cartridges having fuel elements inserted into one end thereof is described in European Patent Publication No. 257,230, which is incorporated herein by reference. Apparatus suitable for manufacturing preferred smoking articles of the present invention are described in European Patent Publication Nos. 299,260 and 299,272, which are incorporated herein by reference.

Figure 1A:
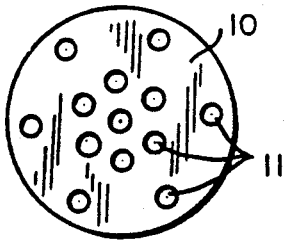
FIG. 1A and 1B illustrate, from the lighting end, preferred fuel element passageway configurations.
Figure 1B:
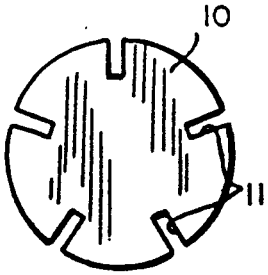

Referring to FIG. 1, there is a cigarette which includes a short, carbonaceous fuel element 10 having a plurality of passageways 11 therethrough, preferably arranged as shown in FIGS. 1A or 1B. The fuel element 10 is shown surrounded or circumscribed by a resilient jacket of insulating fibers 16, such as glass fibers which in turn is wrapped with innerwrapper 34, which may in accordance with the present invention be treated with a burn retardant such as $CaCl_2$.

A heat resistant housing or container 12 is longitudinally disposed behind the fuel element 10. The container 12 normally is manufactured from a heat conductive material such as aluminum.

Within container 12 is positioned a granular or particulate substrate 14, although other forms of substrates, such as heat resistant carbon fibers and densified carbon, alumina or tobacco pellets can be employed. The substrate 14 acts as a carrier for the aerosol forming substances which includes substances such as glycerin, tobacco flavorings agents, and tobacco in forms such as tobacco dust, finely divided tobacco laminae and tobacco extracts. The container 12 has an open end into which the fuel element 10 is inserted, and a closed end having one or more slit-like passageways or slots 20 forming openings therein. Passageways 20 are dimensioned to contain the substrate within the container, while permitting the passage of vaporized aerosol forming materials therethrough.

The container 12 is positioned within, and circumscribed by, a roll of tobacco 18. Normally, the roll of tobacco is a charge of cut filler; although other forms of tobacco, such as extruded tobacco, can be employed. Typically, cut filler includes strands or shreds of tobacco laminate, strands or shreds of reconstituted tobacco, volume expanded strands or shreds of tobacco laminate and processed (e.g., aqueously extracted) tobacco laminate, processed tobacco stems, and the like, as well as blends thereof. The roll of tobacco 18 is circumscribed by wrapping material 33, such as cigarette paper, thereby forming a tobacco rod having the container 12 located therein.

The fuel element 10 which is peripherally circumscribed by the insulating jacket 16 and the tobacco rod is overwrapped by a circumscribing outer wrapper 31 which, in accordance with the present invention has applied thereto a burn additive such as $CaCl_2$ and/or a char-lightening agent such as chalk or $TiO_2$.

Figure 2A:
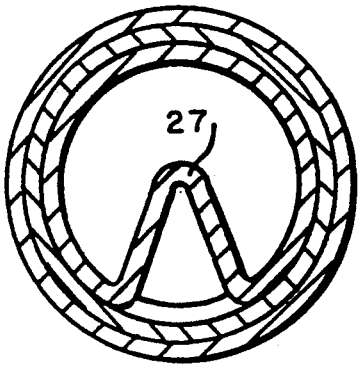
FIGS. 2A–2D are fragmented views of the smoking article of FIG. 1 illustrating means for retaining the aerosol generating capsule in the front end of the smoking article.
Figure 2B:
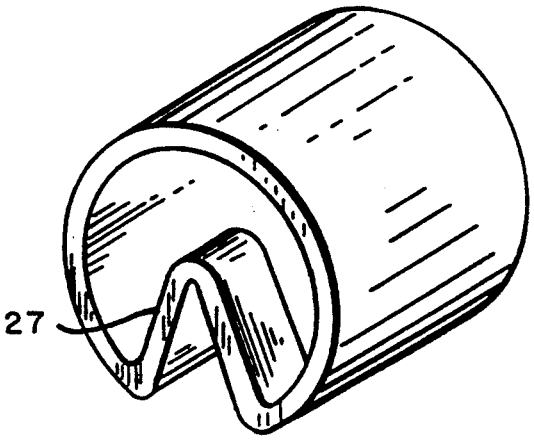
Figure 2C:
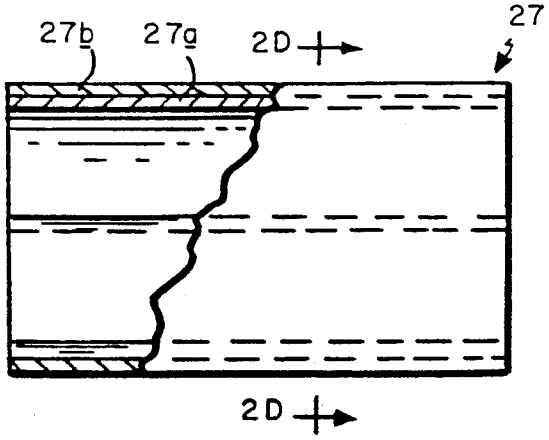
Figure 2D:
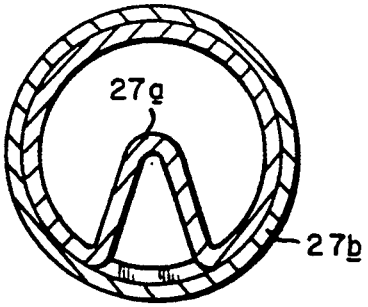

At the mouth end of the tobacco rod is located a mouthend piece 22. The mouth piece normally includes (i) a segment of flavor-containing material 24 (e.g., a loosely gathered web of tobacco paper or carbon filled sheet bearing a flavor such as menthol) wrapped in a paper wrapper 35; and (ii) a filter plug including a segment of filter material 26 (e.g., a pleated or gathered sheet of non-woven thermoplastic fibers) wrapped in a paper wrapper 32. As illustrated in FIG. 1, segment 24 is separated from container 12 by space 25. Paper 35 in this embodiment is partially circumferentially slit and folded inward to form retaining means 27 (see FIG. 2A and 2B) which prevents container 12 from moving into space 25. In another preferred embodiment illustrated in FIGS. 2C and 2D, retaining means 27 is in the form of a tube of rigid paper **27*a* which is partially folded in along its longitudinal length and inserted into rigid paper tube 27*b*. These tubes may replace space 25 and/or segment 24**.

An apparatus suitable for manufacturing such segments such as segment 24 and segment 26 from respective webs of sheet-like materials is described in U.S. Pat. No. 4,807,809 to Pryor et al., which is incorporated herein by reference. See also European Patent Application No. 304,759. The two segments are overwrapped and maintained in place by circumscribing paper 36. Additionally, if desired, a ring of air dilution perforations can be provided, e.g., near the extreme mouthend region of the smoking article, using either laser or mechanical perforation techniques.

The front end of the smoking article, which includes the fuel element and tobacco rod, is positioned in an abutting end-to-end relationship with the mouthend piece, and the front end and mouthend pieces are held in place by tipping material 30 which circumscribes the mouthend piece as well as an adjacent region of the tobacco rod.

Figure 3:
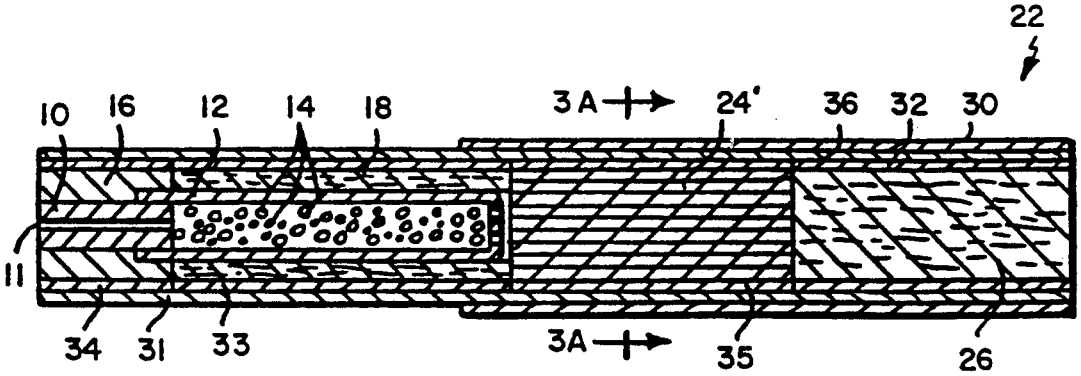
FIG. 3 is a longitudinal view of another preferred smoking article which may employ the wrapper of the present invention.
Figure 3A:
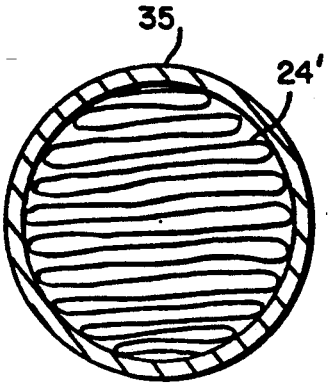
FIG. 3A is a fragmented view of the smoking article of FIG. 3 illustrating the loosely gathered web of tobacco paper of the mouthend piece.

FIG. 3 illustrates another preferred embodiment of the smoking article illustrated in FIG. 1 except that the loosely gathered web of tobacco paper 24' also occupies space 25 of FIG. 1. FIG. 3A depicts the random loosely gathered arrangement of the web of tobacco paper 24'.

The smoking article of the present invention may also have means for determining when the smoking article is lit and/or extinguished. One such means is described in U.S. Pat. No. 4,854,332 to Hanakura which describes a cigarette having thermochromgenic portions thereon. The thermochromogenic composition reversibly changes color at a temperature range of about 40°–80° C. on the surface of the cigarette. Other temperature indicators which could be used on the smoking article of this invention are well known in the art.

The following examples are provided in order to further illustrate various embodiments of the invention but should not be construed as limiting the scope thereof. Unless otherwise noted, all parts and percentages are by weight.

EXAMPLE 1

Cigarettes of the type illustrated in FIGS. 1 and 3 are manufactured in the following manner:

Fuel Source Preparation

A generally cylindrical fuel element 9 mm long and 4.5 mm in diameter, and having an apparent (bulk) density of about 0.93 g/cc is prepared from about 92 parts hardwood pulp carbon having an average particle size of 12 microns in diameter, and 8 parts high viscosity ammonium alginate binder, available as Amoloid HV from Kelco Division of Merck & Co.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 12 microns in diameter.

The finely ground powdered hardwood carbon is admixed with the binder and sufficient water to provide a mixture having a stiff, dough-like paste form.

Fuel elements are extruded using a ram extruder from the paste so as to have 5 peripheral passageways in the form of slots or grooves, each having a depth of about 0.032 inch and a width of about 0.016 inch. The configuration of the passageways which extends longitudinally through the fuel element is shown in FIG. 1B. The resulting extrudate is dried in air to provide a resilient extrudate, and the extrudate is cut into 9 mm lengths, thereby providing fuel elements.

Substrate

The substrate is a densified particulate material consisting of 45 parts of a D2-2600 sintered Alpha alumina from W. R. Grace & Co. in powdered form having an average particle size of 15 microns in diameter, 15 parts of carbon powder having a particle size of 15 microns in diameter, 10 parts of a blended tobacco dust approximately 200 Tyler mesh, 10 parts of cased blended tobacco dust approximately 200 Tyler mesh and 20 parts glycerin and flavors. The substrate is produced by extruding a paste of the above composition onto a rapidly spinning disk which results in the formation of small, roughly spherical balls of the substrate material. The process is generally described and the apparatus is identified in U.S. Pat. No. 4,893,639.

Cartridge Assembly

A hollow metal container is manufactured from aluminum using a metal drawing process. The container has a length of about 30 mm, outer diameter of about 4.5 mm, an an inner diameter of about 4.3 mm. One end of the container is open, and the other end is sealed, except for two slot-like openings, which are about 0.65 mm by 3.45 mm in size and spaced about 1.14 mm apart.

About 340 mg of the treated substrate is loaded into the container. Then, the fuel element is inserted into the open end of the container to a depth of about 2 mm. As such, the fuel element extends 7 mm beyond the open end of the container.

Insulating Jacket

A 15 mm long, 4.5 mm diameter plastic tube is overwrapped with an insulating jacket material that is also 15 mm in length. The insulating jacket is composed of Owens Corning C-glass mat. The resulting diameter of the glass fiber jacket fuel element is about 7.5 mm. The glass jacket is wrapped with the above-described innerwrap paper material P2574-52 which is a paper made from hydrated bleached kraft pulp treated with about 6–8% $CaCl_2$.

Tobacco Roll

A tobacco roll consisting of volume expanded blend of Burley, Flue cured and oriental tobacco cut filler is wrapped in a paper designated as P1487-125 from Kimberly-Clark Corp., thereby forming a tobacco rod having a diameter of about 7.5 mm and a length of about 22 mm.

Frontend Assembly

The innerwrapped insulating jacket section and the tobacco rod are joined together by an overwrap of the above-referenced P2674-190 paper of the present invention which circumscribes the length of the tobacco/-glass jacket section as well as the length of the tobacco roll. P2674-190 has about 11% $CaCl_2$ incorporated into the paper and a coating comprising about 7.8% chalk, 4.3% Kasil® and 1.0% CMC. The mouth end of the tobacco rod is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco rod, simultaneously as the drill and the engaged plastic tube are withdrawn from the mouth end. The cartridge assembly is inserted until the lighting end of the fuel element is flush with the front end of the insulating jacket. The overall length of the resulting front end is about 37 mm.

MouthEnd Piece

A mouthend piece includes a 20 mm long cylindrical segment of a loosely gathered tobacco paper (see FIG. 3A) and a 20 mm long cylindrical segment of a gathered web of non-woven, melt-blown polypropylene, each of which includes an outer paper wrap. (See, e.g., FIG. 3). Each of the segments are provided by subdividing rods prepared using the apparatus described in U.S. Pat. No. 4,808,809 to Pryor et al.

The first segment is about 7.5 mm in diameter, and is provided from a gathered web of tobacco paper available as P144-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP100 from Kimberly-Clark Corp. which is circumscribed by a paper plug wrap available as P1487-184-2 from Kimberly-Clark Corp.

The two segments are axially aligned in an abutting end-to-end relationship, an are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the frontend assembly adjacent the mouthend piece with tipping paper available as 30637-801-12001 from Ecusta Corporation.

For use, the smoker lights the fuel element with a a cigarette lighter and the fuel element burns. The smoker inserts the mouth end of the cigarette into the mouth, and draws on the cigarette. A visible aerosol having tobacco flavor is drawn into the mouth of the smoker.

EXAMPLE 2

Cigarettes of the type illustrated in FIGS. 1 and 3 are manufactured in the following manner:

Fuel Source Preparation

A generally cylindrical fuel element 9 mm long and 4.5 mm in diameter, and having an apparent (bulk) density of about 1.02 g/cc is prepared from about 72 parts hardwood pulp carbon having an average particle size of 12 microns in diameter, about 20 parts of blended tobacco dust including Burley, Flue cured and oriental approximately 200 Tyler mesh and 8 parts Hercules 7HF SCMC binder.

The hardwood pulp carbon is prepared by carbonizing a non-talc container grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 12 microns in diameter.

The finely powdered hardwood carbon is admixed with the tobacco dust, the sodium carboxymethyl cellulose binder, and sufficient water to provide a mixture having a stiff, dough-like paste form.

Fuel elements are extruded using a ram extruder from the paste so as to have 5 peripheral passageways in the form of slots or grooves, each having a depth of about 0.032 inch an a width of about 0.016 inch. The configuration of the passageways which extend longitudinally through the fuel element is shown in FIG. 1B. The resulting extrudate is dried in air to provide a resilient extrudate, and cut into 9 mm lengths thereby providing fuel elements.

Substrate

The substrate is a densified particulate material consisting of 45 parts of D2-2600 sintered Alpha alumina from W. R. Grace & Co. in powdered form having an average particle size of 15 microns in diameter, 15 part of carbon powder having a particle size of 15 microns in diameter, 10 parts of a blended tobacco dust approximately 200 Tyler mesh, 10 parts of cased blended tobacco dust approximately 20 Tyler mesh and 19 parts glycerin and and 1 part flavors. The substrate is produced by extruding a paste of the above composition onto a rapidly spinning disk which results in the formation of small, roughly spherical balls of the substrate material. The process is generally described and the apparatus is identified in U.S. Pat. No. 4,893,639.

Cartridge Assembly

A hollow metal container is manufactured from aluminum using a metal drawing process. The container has a length of about 30 mm, outer diameter of about 4.6 mm, and an inner diameter of about 4.4 mm. One end of the container is open; and the outer end is sealed, except for two slot-like openings, which are about 0.65 mm by 3.45 mm in size and spaced about 1.14 mm apart.

About 340 mg of the substrate is loaded into the container. Then, the fuel element is inserted into the open end of the container to a depth of about 2 mm. The fuel element extends about 7 mm beyond the open end of the container.

Insulating Jacket

A 15 mm long, 4.5 mm diameter plastic tube is overwrapped with an insulating jacket material that is also 15 mm in length. The insulating jacket is composed of Owens Corning C-glass mat with one sheet of reconstituted tobacco paper sandwiched between the layers of the glass and a second sheet of reconstituted tobacco paper overwrapping the outer layer of glass. The reconstituted tobacco sheet, designated P2674-157 from Kimberly-Clark Corp., is a sheet containing a blended tobacco extract. The width of the reconstituted tobacco sheets prior to forming are 19 mm inner and 26.5 mm outer. The final diameter of the jacketed plastic tube is about 7.5 mm.

Tobacco Roll

A tobacco roll consisting of volume expanded blend of Burley, Flue cured and oriental tobacco cut filler is wrapped in a paper designated as P1487-125 from Kimberly-Clark Corp., thereby forming a tobacco rod having a diameter of about 7.5 mm and a length of about 22 mm.

Frontend Assembly

The insulating jacket section and the tobacco rod are joined together by the P2674-190 paper of the present invention described in Example 1, which circumscribes the length of the tobacco/glass jacket section as well as the length of the tobacco roll. The mouth end of the tobacco rod is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco rod, simultaneously as the drill and the engaged plastic tube are withdrawn from the mouth end. The cartridge assembly is inserted until the lighting end of the fuel element is flush with the front end of the insulating jacket. The overall length of the resulting front end is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 to Pryor et al.

The first segment is about 7.5 mm in diameter, and is provided from a loosely gathered web of tobacco paper available as P144-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP100 from Kimberly-Clark Corp. which is circumscribed by a paper plug wrap available as P1187-184-2 from Kimberly-Clark Corp.

The two segments are axially aligned in an abutting end-to-end relationship, and are combined by circumscribing the length of each of the segments with a paper overwrap available as L-137-19F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent the mouthend piece with tipping paper available as 30637-801-12001 from Ecusta Corporation.

EXAMPLE 3

Smoking articles similar to those described in Example 1 were constructed with an untreated innerwrap P850-185 from Kimberly-Clark Corp. having a basis weight of about 31 g/m$^2$ and Coresta porosity of about 3300 cm/min., and an outerwrap comprising the P850-185 having about 8% $NH_4Cl$ incorporated during processing. During smoking, these articles produced very little sidestream smoke and a black char at the fuel end.

EXAMPLE 4

Smoking articles similar to those described in Example 3 were constructed with an untreated innerwrap P850-185, and an outerwrap comprising the P850-185 having about 8% $MgCl_2$ incorporated during processing. During smoking, these articles produced very little sidestream smoke and a black char at the fuel end.

EXAMPLE 5

Smoking articles similar to those described in Example 1 were constructed with a treated innerwrap P850-185 having about 8% $CaCl_2$, and an outerwrap comprising the P850-185 having about 8% $CaCl_2$ incorporated during processing. During smoking, these articles produced very little sidestream smoke and a black char at the fuel end.

EXAMPLE 6

Smoking articles similar to those described in Example 1 were constructed with an untreated innerwrap P850-185, and an outerwrap comprising the P850-185 having about 6% disodium phosphate incorporated during processing. During smoking, these articles produced very little sidestream smoke and a black char at the fuel end.

EXAMPLE 7

Smoking articles similar to those described in Example 1 were constructed with the following outerwrap. The base paper was composed of hydrated bleached kraft pulp with the burn retardant being added to the pulp during the papermaking process. The remaining chemicals were added as a coating thereto.

| Kimberly-Clark Paper No. | Coresta porosity | Basis weight (uncoated) | Chemical level |
|---|---|---|---|
| P2301-115-A Coating | 2700 | 34.5 g/m$^2$ | 8% $CaCl_2$<br>7.8% Chalk<br>5.9% Kasil<br>0.7% CMC |
| P2301-115-B Coating | 4500 | 21.9 g/m$^2$ | 8% $CaCl_2$<br>8.3% Chalk<br>6.2% Kasil<br>0.8% CMC |
| P2301-116-C Coating | 6500 | 20.8 g/m$^2$ | 8% $CaCl_2$<br>8.2% Chalk<br>6.1% Kasil<br>0.8% CMC |

During smoking, these articles produced desirable amounts of aerosol with reduced sidestream smoke.

What is claimed is:

1. An improved wrapper for a smoking article having a combustible fuel element encircled at least in part by an air permeable insulating layer and a physically separate aerosol generating means including an aerosol forming material, the wrapper encircling at least a portion of the insulating layer, and comprising a paper treated with a burn retardant in an amount whereby a substantial amount of the wrapper in the form of charred cellulose and/or ash constituents remains after lighting.

2. The improved wrapper of claim 1, wherein the amount of the wrapper in the form of charred cellulose and/or ash constituents which remains after lighting is greater than about 30 weight percent.

3. The improved wrapper of claim 1, wherein the amount of the wrapper in the form of charred cellulose and/or ash constituents which remains after lighting is greater than about 40 weight percent.

4. The improved wrapper of claim 1, wherein the amount of the wrapper in the form of charred cellulose and/or ash constituents which remains after lighting is between about 45 and 75 weight percent.

5. The improved wrapper of claim 1, wherein the wrapper has a Coresta porosity before smoking of between about 5 and 6500 cm/min.

6. The improved wrapper of claim 1, wherein the wrapper has a Coresta porosity before smoking of between about 100 and 3000 cm/min.

7. The improved wrapper of claim 1, wherein the wrapper has a Coresta porosity before smoking of between about 300 and 2000 cm/min.

8. The improved wrapper of claim 1, wherein the burn retardant is selected from the group consisting of calcium chloride, ammonium chloride, magnesium chloride, magnesium sulfate, mono-ammonium sulfate, disodium phosphate, and mixtures thereof.

9. The improved wrapper of claim 8, wherein the burn retardant comprises calcium chloride.

10. The improved wrapper of claim 8 or 9, wherein the amount of burn retardant is between about 3 and 15 weight percent of the wrapper.

11. The improved wrapper of claim 8 or 9, wherein the amount of burn retardant is between about 6 and 13 weight percent.

12. The improved wrapper of claim 8 or 9, wherein the amount of burn retardant is between about 8 and 11 weight percent.

13. The improved wrapper of claim 1, further comprising a char-lightening agent.

14. The improved wrapper of claim 13, wherein the char-lightening agent is selected from the group consisting of chalk, clays, $TiO_2$, MgO, and mixtures thereof.

15. The improved wrapper of claim 14, wherein the char-lightening agent comprises chalk or $TiO_2$.

16. The improved wrapper of claim 15, wherein the burn retardant is $CaCl_2$ and the amount of char-lightening agent is between about 1 and 50 weight percent of the wrapper.

17. The improved wrapper of claim 15, wherein the burn retardant is $CaCl_2$ and the amount of char-lightening agent is between about 4 and 20 weight percent.

18. The improved wrapper of claim 15, wherein the burn retardant is $CaCl_2$ and the amount of char-lightening agent is between about 6 and 8 weight percent.

19. The improved wrapper of claim 1 or 13, further comprising additives selected from the group consisting of hydrated silica and binder.

20. A smoking article comprising:

(a) a fuel element;

(b) a physically separate aerosol generating means longitudinally disposed behind the fuel element and including at least one aerosol forming material;

(c) an air permeable insulating layer which encircles at least a portion of the fuel element; and (d) a wrapper which at least partially encircles the insulating layer comprising comprising at least one paper treated with a burn retardant in an amount whereby a substantial portion of the wrapper in the form of charred cellulose and/or ash constituents remains after lighting.

21. The smoking article of claim 20, wherein the amount of the wrapper in the form of charred cellulose and/or ash constituents which remains after lighting is greater than about 30 weight percent.

22. The smoking article of claim 20, wherein the amount of the wrapper in the form of charred cellulose and/or ash constituents which remains after lighting is greater than about 40 weight percent.

23. The smoking article of claim 20, wherein the amount of the wrapper in the form of charred cellulose and/or ash constituents which remains after lighting is between about 45 and 75 weight percent.

24. The smoking article of claim 20, wherein the wrapper has a Coresta porosity before smoking of between about 5 and 6500 cm/min.

25. The smoking article of claim 20, wherein the wrapper has a Coresta porosity before smoking of between about 100 and 3000 cm/min.

26. The smoking article of claim 20, wherein the wrapper has a Coresta porosity before smoking of between about 300 and 2000 cm/min.

27. The smoking article of claim 20, wherein the burn retardant is selected from the group consisting of calcium chloride, ammonium chloride, magnesium chloride, magnesium sulfate, mono-ammonium sulfate, disodium phosphate, and mixtures thereof.

28. The smoking article of claim 27, wherein the burn retardant comprises calcium chloride.

29. The smoking article of claim 27 or 28, wherein the amount of burn retardant is between about 3 and 15 weight percent of the wrapper.

30. The smoking article of claim 27 or 28, wherein the amount of burn retardant is between about 6 and 13 weight percent.

31. The smoking article of claim 27 or 28, wherein the amount of burn retardant is between about 8 and 11 weight percent.

32. The smoking article of claim 20, further comprising a char-lightening agent.

33. The smoking article of claim 32, wherein the char-lightening agent is selected from the group consisting of chalk, clays, $TiO_2$, MgO, and mixtures thereof.

34. The smoking article of claim 33, wherein the char-lightening agent comprises chalk or $TiO_2$.

35. The smoking article of claim 34, wherein the burn retardant is $CaCl_2$ and the amount of char-lightening agent is between about 1 and 50 weight percent of the wrapper.

36. The smoking article of claim 34, wherein the burn retardant is $CaCl_2$ and the amount of char-lightening agent is between about 4 and 20 weight percent.

37. The smoking article of claim 34, wherein the burn retardant is $CaCl_2$ and the amount of char-lightening agent is between about 6 and 8 weight percent.

38. The smoking article of claim 20 or 32, further comprising additives selected from the group consisting of hydrated silica and binder.

39. The smoking article of claim 20, wherein the wrapper comprises an innerwrap and an outerwrap.

40. The smoking article of claim 39, wherein a burn retardant is on both the innerwrap and outerwrap.

41. The smoking article of claim 40, further comprising a coating applied to the outerwrap.

42. The smoking article of claim 41, wherein the coating comprises a char-lightening agent.

43. The smoking article of claim 42, wherein the coating further comprises a hydrated silica.

44. The smoking article of claim 20 or 39, wherein the fuel element is carbonaceous.

45. The smoking article of claim 44, wherein the fuel element is less than about 30 mm in length and has a diameter less than about 8 mm.

46. The smoking article of claim 44, wherein the aerosol generating means is in a conductive heat exchange relationship with the fuel element.

47. The smoking article of claim 44, wherein the insulating layer is at least about 0.5 mm thick.

48. The smoking article of claim 45, further comprising a heat conducting member, which member contacts at least a portion of the fuel element and at least a portion of the aerosol generating means.

* * * * *